US007472482B2

(12) United States Patent
Pratt

(10) Patent No.: US 7,472,482 B2
(45) **Date of Patent: *Jan. 6, 2009**

(54) METHOD OF ASSEMBLING A GUARD RAIL

(75) Inventor: Jim Pratt, Newmarket (CA)

(73) Assignee: Azek Canada Inc., Toronto (CA)

( * ) Notice: Subject to any disclaimer, the term of this patent is extended or adjusted under 35 U.S.C. 154(b) by 270 days.

This patent is subject to a terminal disclaimer.

(21) Appl. No.: 11/409,005

(22) Filed: Apr. 24, 2006

(65) Prior Publication Data

US 2006/0196053 A1 Sep. 7, 2006

Related U.S. Application Data

(63) Continuation of application No. 10/753,423, filed on Jan. 9, 2004, now abandoned, which is a continuation-in-part of application No. 09/994,736, filed on Nov. 28, 2001, now Pat. No. 6,702,259.

(51) Int. Cl.
*B21D 39/03* (2006.01)

(52) U.S. Cl. ..... 29/897.35

(58) Field of Classification Search ..... 29/897.35, 29/897, 525.01, 428; 256/65.03, 19, 59, 256/65.01, 65.02, 65.07, 21, 24
See application file for complete search history.

(56) References Cited

U.S. PATENT DOCUMENTS 5,516,472 A 5/1996 Laver
6,702,259 B2 * 3/2004 Pratt ..... 256/65.03

FOREIGN PATENT DOCUMENTS

CA 2153659 5/1995

OTHER PUBLICATIONS

Geoff McDuffie of Henderson, Black & Green Inc. (hereinafter, HB&G), fax dated Nov. 7, 1997 to Jim Pratt attaching cross sectional drawings.
HB&G brochurre/document dated Feb. 12, 1996 and received Nov. 7, 1997.
HB&G, Brochure entitled "PermaPorch System" and dated May 2000.
Smartdeck, Brochure entitled "Railing Installation Guide" and dated 1999, and received by Jim Pratt on Feb. 1, 2000 from Biewer Lumber.
HB&G, PermaPorch Railing "Installation Instructions" dated Jan. 3, 1997, and received by Jim Pratt in Jan./Feb. 2000.

(Continued)

*Primary Examiner*—John C Hong
(74) *Attorney, Agent, or Firm*—Dimock Stratton LLP; Mark B. Eisen

(57) ABSTRACT

A guard rail system fabricated from standard-sized components, preferably extruded, comprises balusters fastened to a lower rail and to an upper retainer at fixed intervals. The balusters are provided with central bores for receiving fasteners such as screws through predrilled holes in the upper retainer and lower rail. A hand rail is slip-fitted over the upper retainer in locking relation, to provide integrated guard rail sections. Guard rail sections so assembled are fastened to end posts, preferably using mounting brackets having a flanged arm which nests in grooves or recesses in the upper retainer and lower rail to provide a safe, secure and aesthetically appealing guard rail.

4 Claims, 5 Drawing Sheets

OTHER PUBLICATIONS

Strandex, "3600 Wood/Plastic Composite—Assembly and Installation Instructions", received by Jim Pratt as early as 1996 or 1997.
Composite Railing System, Installation Instructions, brochure, publicly provided to third party in Feb./Mar. 2000.
Letter dated Feb. 14, 2001 from Jim Pratt of Comptrusion Corporation (Redacted).
Comptrusion Corporation, EcoComposite Systems—The Ultimate in Composite Technology, Brochure, Published in Canada in May/Jun. 2001.
Tom Smith of Strandex,"CCorp—Hand Rail, #1308", drawings received by Jim Pratt on Jan. 4, 2000.
Biewer Lumber, eXcel Railing System, brochure, date of publication unknown.
Monarch (a division of Biewer Lumber), brochure, Obtained from the Internet in 2002.
Comptrusion Corporation, EcoRail Systems—The Latest in Wood Composite Technology, brochure, made publicly available in Mar./Apr. 2000.
Letter dated May 14, 1999 from IM PRATT (of Comptrusion Corporation) (Redacted).
Jim Pratt and Wiretron Technologies, Baluster with Center bore (Oct. 19, 2000) and Hand Rail with bearing plair (Feb. 7, 2001), CAD file.

* cited by examiner

METHOD OF ASSEMBLING A GUARD RAIL

CROSS-REFERENCE TO RELATED APPLICATIONS

This application is a Continuation of application Ser. No. 10/753,423, filed Jan. 9, 2004, entitled GUARD RAIL SYSTEM, which is a Continuation-in-Part of application Ser. No. 09/994,736, filed Nov. 28, 2001, entitled GUARD RAIL SYSTEM, which are incorporated by reference herein.

FIELD OF THE INVENTION

This invention relates to guard rail systems. In particular, this invention relates to a prefabricated guard rail system, components for a guard rail system and kits of components for a guard rail system, which is strong, inexpensive, easy to assemble and self-aligning, and meets the requirements of local building codes.

BACKGROUND OF THE INVENTION

Guard rails are used around decks, staircases and other elevated structures, to prevent injury and possible death from falling off of the edge of such structures. Most building codes have rigid requirements for guard rails, both in terms of when they are required and certain construction parameters, including for example the maximum spacing between balusters, length of span, height and load requirements.

The installation of guard rail systems can be a very labour intensive procedure. Balusters must be installed at precise intervals, and be substantially true to the vertical, both to comply with building code requirements and to be aesthetically acceptable.

Guard rails can be constructed from lumber, and frequently are in order to keep costs down. In a typical lumber guard rail construction balusters or pickets are nailed or screwed to top and bottom rails, which in turn are nailed to posts secured to or around the structure. A considerable amount of attention is required to ensure that the balusters are evenly spaced and vertical, and there is a limit to the aesthetic appeal which can be achieved. Moreover, the resulting guard rail is subject to separation, warping and other weathering effects over time, due to limits on the strength and degree of structural integration which can be achieved using nails and lumber.

The fabrication of components for guard rail systems can be facilitated by extruding components, for example out of a synthetic wood composition, plastic, aluminium or another suitable material. However, whether cut from lumber or extruded, the assembly and installation of the guard rail requires considerable skill, labour and time in order to construct a guard rail which is both structurally secure and appealing.

There is accordingly a need for a guard rail system which is easy to assemble, inexpensive, and produces a durable, structurally integrated guard rail which both meets building code requirements and is aesthetically appealing.

SUMMARY OF THE INVENTION

The present invention overcomes these disadvantages by providing a guard rail system fabricated from standard-sized components, which is strong enough to meet and exceed building code requirements. According to the invention, balusters which are preferably (but not necessarily) extruded are fastened to a lower rail and to an upper retainer at fixed intervals. The balusters are provided with central bores for receiving fasteners such as screws through predrilled holes in the upper retainer and lower rail. A hand rail is slip-fitted over the upper retainer in locking relation, to provide integrated guard rail sections. In the preferred embodiment guard rail sections so assembled are fastened by means of a special bracket system to end posts to provide a safe, secure and aesthetically appealing guard rail.

The invention provides a versatile, easy to assemble and structurally secure guard rail system which can be used in any application where conventional guard rails are used.

The present invention thus provides a guard rail system, comprising a top retainer and a bottom rail affixed between at least two posts, a plurality of hollow balusters extending between the top retainer and the bottom rail, each baluster comprising a plurality of inner webs affixed to a wall of the baluster and to a bore for a fastener disposed within the baluster wall, and a hand rail affixed to the top retainer, wherein the balusters are affixed between the top retainer and the bottom rail by fasteners disposed through the top retainer and the bottom rail and into the bore.

The present invention further provides a guard rail system, comprising a top retainer and a bottom rail affixed between at least two posts, a plurality of hollow balusters extending between the top retainer and the bottom rail, each baluster comprising a plurality of inner webs affixed to a wall of the baluster and to a bore for a fastener disposed within the baluster wall, and a hand rail affixed to the top retainer, the hand rail having a bearing plate supported by an upper surface of the upper retainer, wherein the upper retainer has an exterior surface having a pair of opposed channels and the hand rail has an internal surface having a pair of complementary projections, whereby the hand rail is affixed to the upper retainer by sliding engagement between the projections and the channels.

In further aspects of the guard rail system of the invention: the top retainer and the bottom rail each have a series of pre-drilled holes for receiving the fastening members, to thereby align the balusters; a front of the bottom rail is provided with an upstanding lip spaced from the series of holes by a distance substantially corresponding to a distance between the bore and a front face of the baluster; the upper retainer has an exterior surface having a pair of opposed channels and the hand rail has an internal surface having a pair of complementary projections, whereby the hand rail is affixed to the upper retainer by sliding engagement between the projections and the channels; the hand rail is provided with a bearing plate supported by an upper surface of the upper retainer; a portion of the hand rail above the bearing plate is hollow; the balusters have a substantially square cross section and a substantially central bore; the webs extend from corners of the baluster wall to the bore; the posts are hollow and provided bosses disposed along an interior wall of the post, for abutting against a structural member disposed through each post; and/or the top retainer and bottom rail are affixed to the posts by a bracket comprising a flanged arm having depending flanges spaced apart so as to nest in grooves formed in the top retainer and bottom rail, to thereby interlock the bracket with the top retainer and bottom rail.

The present invention further provides a method of assembling a guard rail, comprising the steps of: a. pre-drilling a top retainer and a bottom rail for attachment to a plurality of hollow balusters, the top retainer having an exterior surface having a pair of opposed channels and each baluster comprising a plurality of inner webs affixed to a wall of the baluster and to a bore for a fastener disposed within the baluster wall, b. disposing fasteners through the holes into the bores to affix the balusters between the top retainer and bottom rail, c.

sliding a hand rail having an internal surface having a pair of projections complementary to the channels over the upper retainer to engage the projections in the channels, and d. affixing the top retainer and the bottom rail to posts.

In further aspects of the method of the invention: the hand rail comprises a bearing plate supported by an upper surface of the upper retainer; the method includes, before step a., the step of extruding the top retainer, bottom rail, balusters and hand rail; each post is hollow and the method includes the steps of anchoring a structural member and disposing the post over a structural member; and/or the top retainer and bottom rail are affixed to the posts by a bracket comprising a flanged arm having depending flanges spaced apart so as to nest in grooves formed in the top retainer and bottom rail, to thereby interlock the bracket with the lower rail and upper retainer.

BRIEF DESCRIPTION OF THE DRAWINGS

In drawings which illustrate by way of example only a preferred embodiment of the invention.

DETAILED DESCRIPTION OF THE INVENTION

Figure 1:
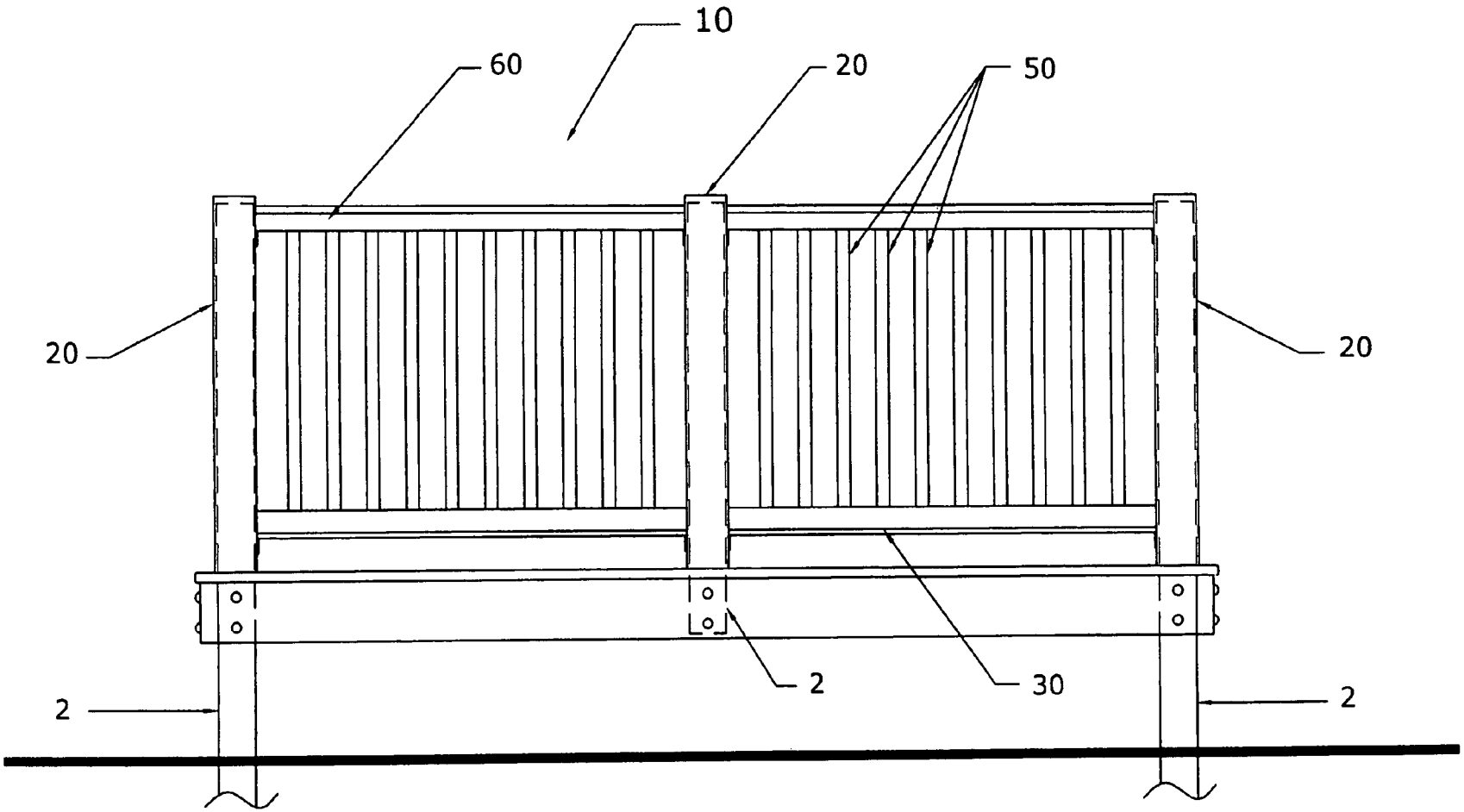
FIG. 1 is an elevation of a guard rail system according to the invention on a sun deck.

FIG. 1 illustrates a guard rail system 10 according to the present invention. The guard rail system 10 is illustrated in the environment of a sun deck for purposes of example only, however it will be appreciated that the guard rail system is adaptable to any environment in which a conventional guard rail system may be used.

Figure 3:
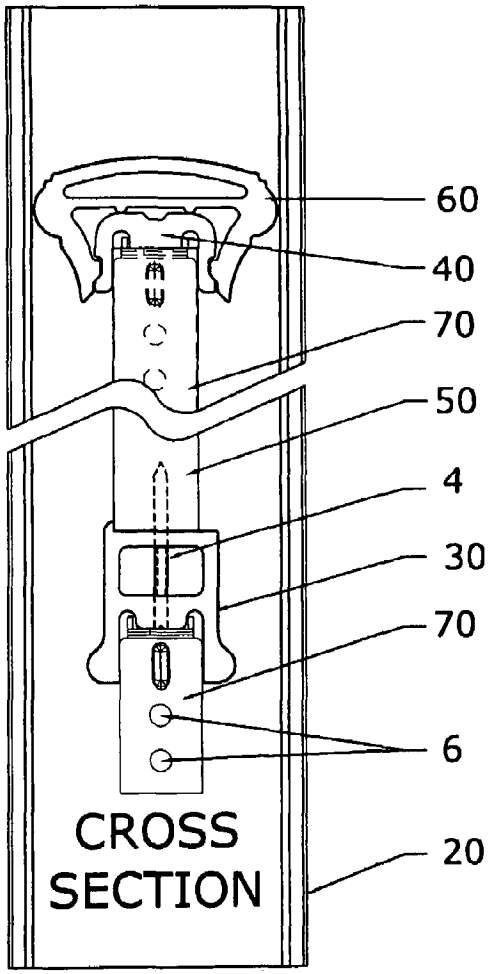
FIG. 3 is a cross sectional end elevation of the guard rail system of FIG. 1.
Figure 2:
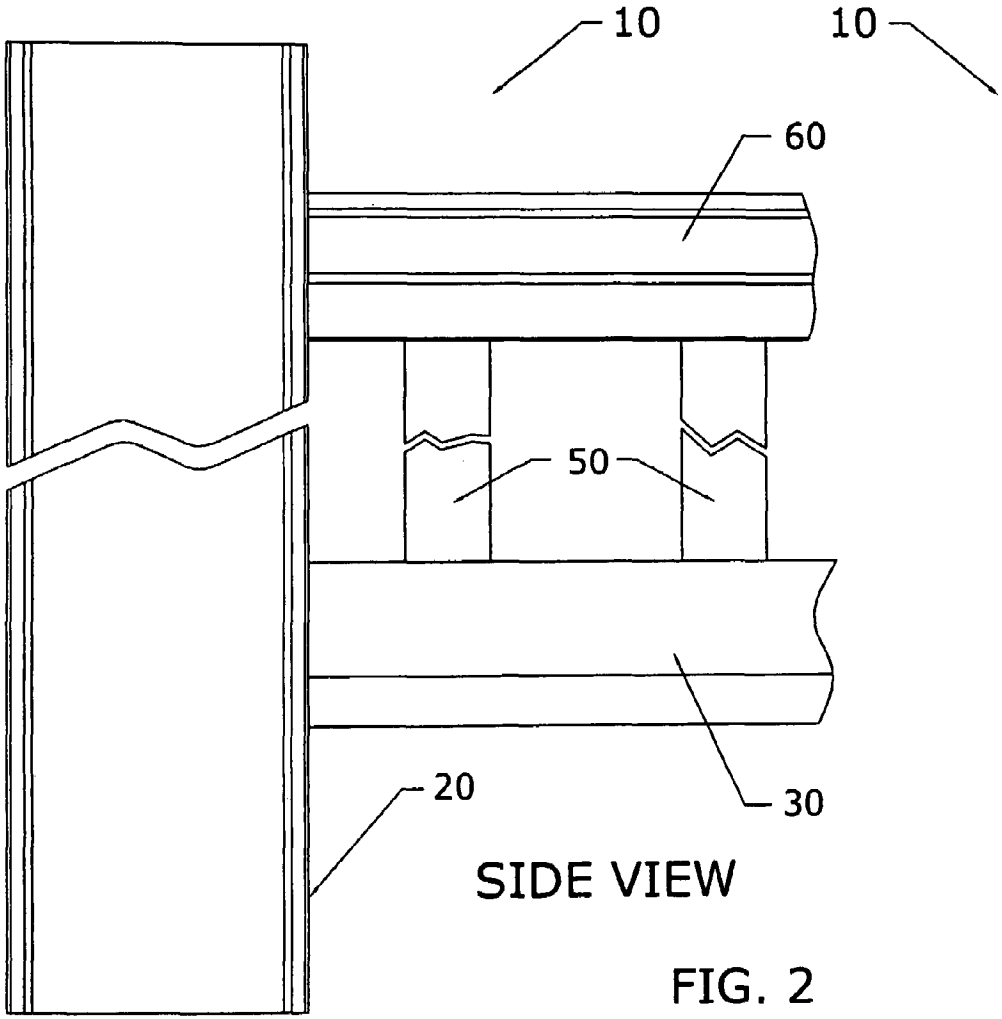
FIG. 2 is a cross sectional front elevation of the guard rail system of FIG. 1.

In a preferred embodiment the components of the guard rail system are entirely extruded, for example in accordance with the technique described in U.S. Pat. No. 5,516,472 for an Extruded Synthetic Wood Composition and Method for Making Same issued May 14, 1996 to Strandex Corporation, and Canadian Patent No. 2153659 issued Feb. 23, 1999 to Strandex Corporation, which are incorporated herein by reference. However, the components of the invention may alternatively be milled from wood, molded or extruded from plastic or metal, or otherwise suitably formed. The particular material or materials from which the components of the guard rail are formed is limited only by the requirement for sufficient structural strength in the finished railing to comply with building code requirements. FIGS. 2 and 3 illustrate the various components of the invention, comprising an end post 20, a lower rail 30, an upper retainer 40, balusters 50 and a hand rail 60. In the preferred embodiment the invention further includes a specially designed bracket 70 for fastening the guard rail sections to the end posts.

Figure 5:
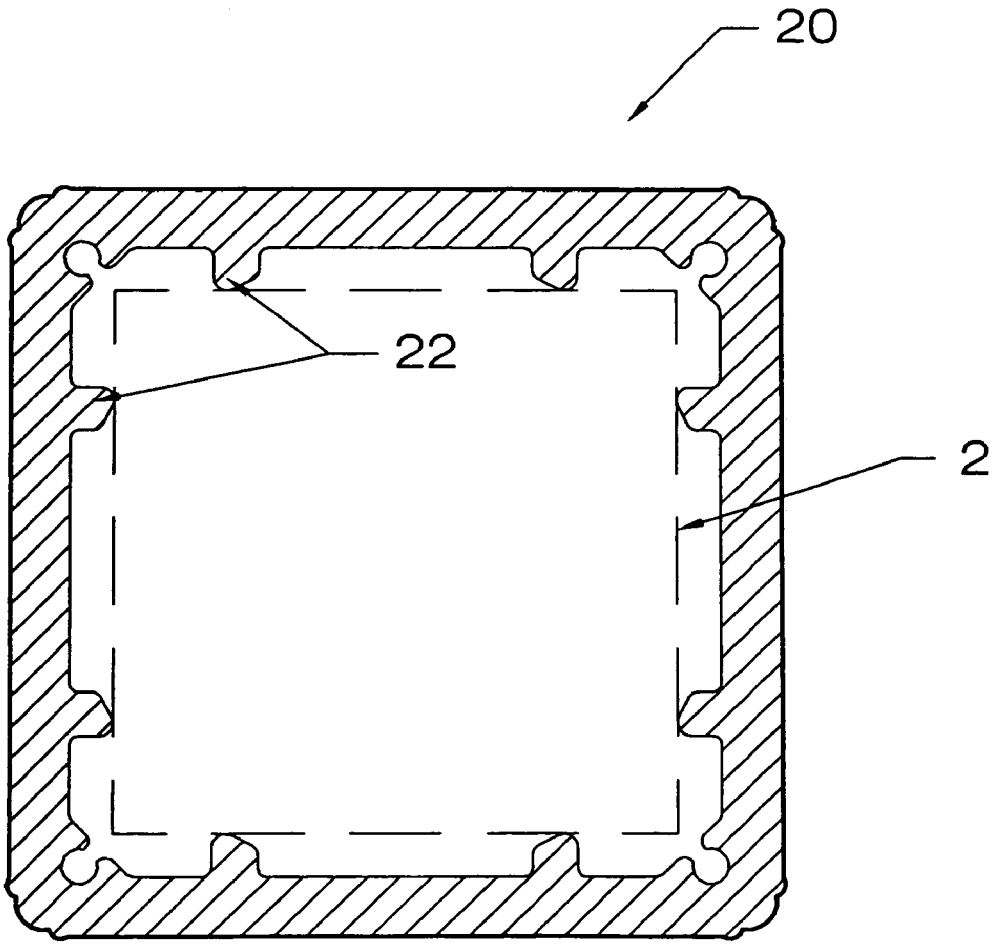
FIG. 5 is a cross section of an end post of FIG. 1.

The end post 20, illustrated in FIG. 5, is preferably hollow and has an interior dimension which allows the end post 20 to be slip-fitted over a structural member 2 (shown in phantom in FIG. 5) such as a 4×4 pressure treated post, 2×4 pressure treated lumber or a 3½ inch steel pipe (for example of the type used in chain link fencing), which is anchored into the ground, deck substructure or other foundation for the guard rail 10. In the preferred embodiment the end post 20 comprises vertical ridges 22 which snugly abut the four by four post 2 in order to fix the end post 20 in a stable, vertical position.

Rail sections are formed by a series of balusters 50 fastened to the lower rail 30 and the upper retainer 40. The lower rail 30 and upper retainer 40 are preferably predrilled at the desired positions for the balusters, for example 4 inches on-center (OC).

Figure 7:
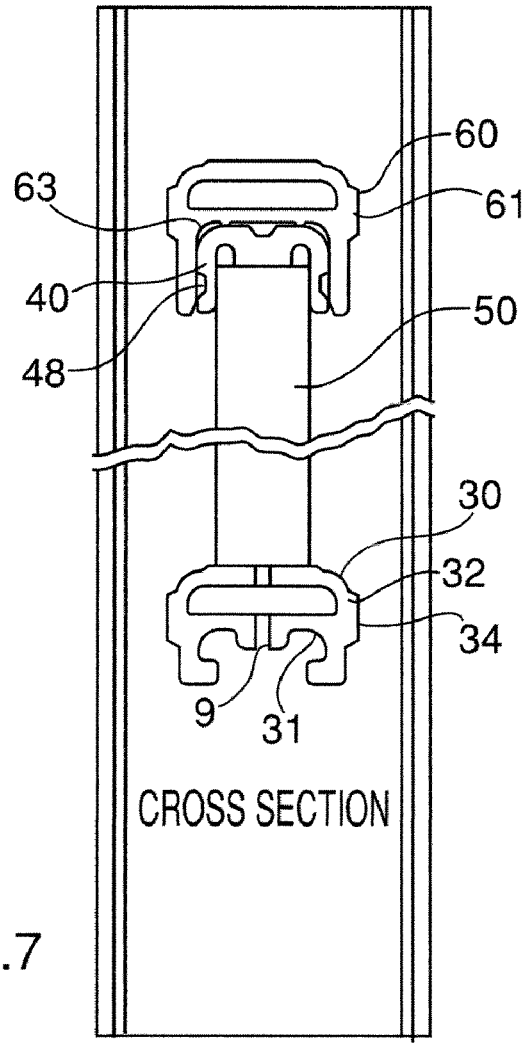
FIG. 7 is a cross section of the lower rail, baluster, upper retainer, and handrail of an embodiment of the invention.

The lower rail 30, shown in FIG. 7, preferably comprises a hollow body 32 having decorative flanges 34 depending therefrom, serves to impart aesthetic appeal to the lower rail 30 and to hide the hardware such as screws 4 which secure the balusters 50 and brackets 70 (shown in FIG. 9) which secure the lower rail 30 to the end post 20. In a preferred embodiment, an alignment lip (not shown) serves the purposes of both aligning the balusters 50 along the lower rail 30 and concealing any small gap between the balusters 50 and the body 32 of the lower rail 30 after the balusters 50 have been fastened thereto.

Figure 6:
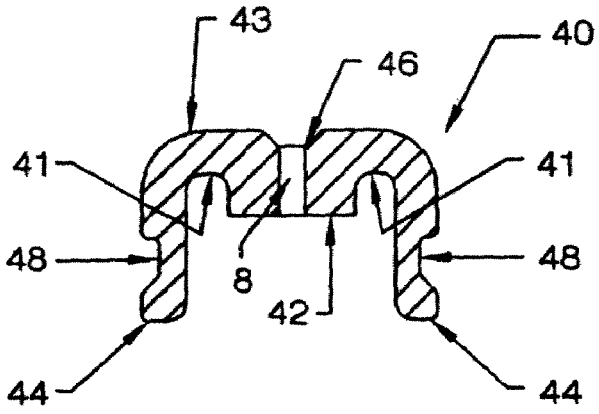
FIG. 6 is a cross section of the upper retainer of FIG. 1.

The upper retainer 40, shown in FIG. 6, comprises an abutment plate 42 extending axially along the upper retainer 40 which abuts the top ends of the balusters 50, and a pair of wings 44 which are preferably dimensioned to overlap the sides of the balusters 50, holding the balusters 50 in place and keeping them from rotating, as shown in FIG. 3. Preferably the row of drill holes 8 is contained within a longitudinal recess 46, so that the heads of fasteners such as screws 6 or recessed relative to, or at least are flush with, the top face 43 of the upper retainer 40, thereby avoiding the need to countersink screws 6 when the balusters 50 are fastened to the upper retainer 40.

The hand rail 60, shown in FIG. 7, has an exterior surface 61 configured in any desired shape or pattern for usability and aesthetic appeal. The interior surface 63 of the hand rail 60 is configured to slip-fit over the upper retainer 40. The hand rail 60 is slip-fit over the upper retainer 40. Preferably the interior surface 63 has a bearing plate 64 having ridges or bosses 66 which bear on the top surface 43 of the upper retainer 40, to snugly secure the handrail 60 in position. Preferably there is a hollow between the bearing plate 64 and the upper surface of the hand rail 60, which increases strength, and reduces the cost and weight of the hand rail 60. Also, a slight flexibility in the bearing plate 64 and the wings 62 allows the hand rail 60 to grip the upper retainer 40 when slip-fitted thereto.

Figure 4:
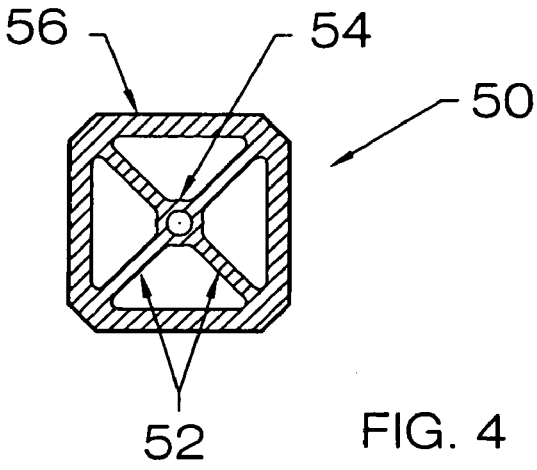
FIG. 4 is a cross section of a baluster of FIG. 1.

The balusters 50, shown in FIG. 4, may be formed in any desired decorative shape, and may be symmetrical in cross section. Each baluster 50 is hollow and provided with inner webs 52 affixed to the wall of the baluster 50 and supporting a bore 54, which preferably extends along the entire length of the baluster 50. In the embodiment shown the balusters 50 each have a square cross section and the webs 52 extend from the corners of the baluster wall toward a central bore 54.

The spacing between the bore 54 and the front outer face 56 of the baluster 50 corresponds to the spacing between the predrilled holes 8 and the wings 44 of the upper retainer 40, and to the spacing between the predrilled holes 9 and the lip 36 of the lower rail 30. Thus, when assembled in the manner described below, the balusters 50 will self align against the wings 44 and the lip 36 to align the balusters relative to one another, and to square the balusters relative to the rail section when the upper retainer 40 and lower rail 30 are affixed to the end post 20.

Figure 8:
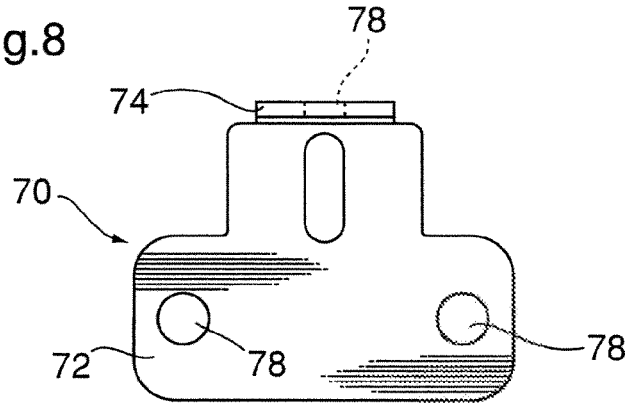
FIG. 8 is a side elevational view of a bracket for fastening the guard rail sections to the end posts, according to one embodiment of the invention.
Figure 9:
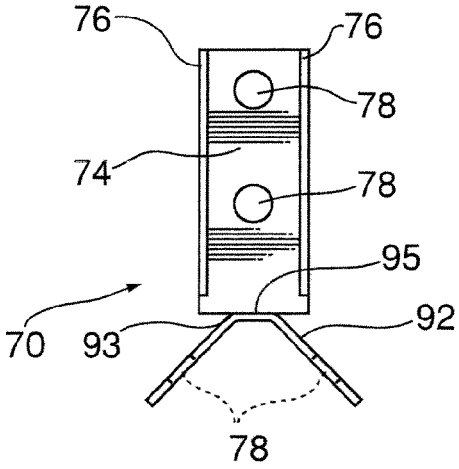
FIG. 9 is a plan view of a bracket, according to a further embodiment of the invention.
Figure 10:
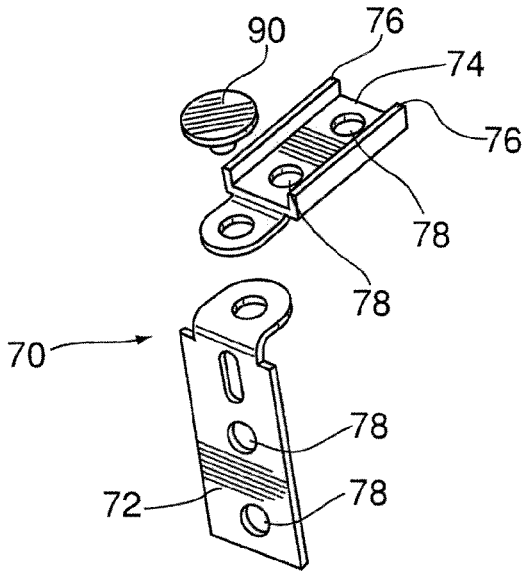
FIG. 10 is an exploded perspective view of a bracket according to yet a further embodiment of the invention.

Preferably, the upper retainer 40 and lower rail 30 are affixed to the end post 20 by a bracket 70, illustrated in FIG. 8, comprising a flat arm 72 having screw holes 78, extending generally perpendicular to an arm 74 having screw holes 78. The bracket 70 may be stamped or otherwise suitably formed from metal. In a preferred embodiment, depending flanges 76 are provided on the arm 74, and are spaced apart so as to nest in grooves or recesses 31 and 41 respectively formed in the underside of lower rail 30 and upper retainer 40, as can be seen in FIGS. 9 and 10, thus interlocking with the lower rail 30 and upper retainer 40 for increased strength and stability. In a preferred embodiment, the bracket 70 is configured to permit the upper retainer 40 and the lower rail 30 to be affixed to the end post 20 at an angle. As shown in FIG. 10, the bracket 70 may comprise a flat arm 72 having screw holes 78 for affixing to an end post 20. The bracket 70 further comprises a generally perpendicular flanged arm 74 rotatably mounted on the flat arm 72 by means of a fastener 90, such as a rivet or another suitable fastening means. The perpendicular flanged arm 74 is provided with screw holes 78 and depending flanges 76, which are spaced apart so as to nest in the grooves or recesses 31 and 41 formed in the underside of lower rail 30, and upper rail 40. The flat arm 72 and the flanged arm 74 may likewise be stamped or otherwise formed from metal. While the fastener 90 in the rotating bracket 70 shown in FIG. 10 provides rotational movement over a full 360°, when the bracket 70 is mounted in a guard rail assembly, full rotation may be restricted to a range of less than 360°, since full rotation will be hampered by the interference of the upper retainer 40, lower rail 30, and the end post 20. However, with the rotating bracket 70, the guard rail assembly may be configured to surround an irregularly (non-rectangular) shaped area.

In a further embodiment, the bracket 70 is shaped to fit around a vertex of an end post 20. Referring to FIG. 9, the bracket 70 is provided with an angled arm 92, which is shaped to fit around the corner of an end post 20, preferably at a 90° angle. The angled arm 92 is provided with screw holes 78 for mounting to the end post 20. A generally perpendicular flanged arm 74 extends from the angled arm 92. and is provided with screw holes 78 and depending flanges 76, which are spaced apart so as to nest in the grooves or recesses 31 and 41 formed in the underside of lower rail 30 and upper rail 40. In the preferred embodiment, the vertex 93 of the angled bracket 70 shown in FIG. 12 truncated to provide an edge for the join 95 between the angled arm 92 and the flanged arm 74. If the angled bracket 70 is integrally formed, for example by metal stamping or another suitable method, when formed the bracket 70 may be bent along the join 95. Alternatively, if the bracket 70 is formed from a separate flanged arm 74 and an angled arm 92, the join 95 may be formed by spot welding or other means.

To assemble the guard rail of the invention, the end posts 20 are fitted over suitably dimensioned structural posts 2 such as four-by-four treated lumber, and positioned to rest on the deck, floor, stair or other elevated structure. The rail sections are assembled by driving fasteners such as screws 6 through the predrilled holes 8 in the upper retainer 40 into the bores 54 in the balusters 50. The lower rail 30 is similarly fastened to the bottom ends of the balusters 50 by driving fasteners such as screws 6 through the predrilled holes 9 into the bores 54. The rail section so constructed is integrated and structurally secure. The rail sections may be constructed to any suitable length, and can be assembled to a single length of lower rail 30 and upper retainer 40, depending upon the material from which the rail section is formed.

A length of hand rail 60 is cut to match the length of the assembled rail section, and slip-fitted over the upper retainer 40 by aligning ridges or bosses 62 with channels 48 and sliding the hand rail 60 along the upper retainer 40 until the upper retainer 40 is fully concealed. The rail section is then mounted between end posts 20 by brackets 70 affixed to the upper retainer 40 and lower rail 30 using suitable fastening members, in the case of a wood composite or synthetic wood composite, preferably bolts with wood or other suitable inserts (not shown), and preferably screws 6 extending through the wall of the end post 20 into the structural member 2 for strength.

It will be appreciate by those skilled in the art that the particular configurations of the components of the guard rail system of the invention may be altered to suit specific installation parameters and/or aesthetic or decorative requirements. For example, the embodiment illustrated shows plain-faced, square-shaped balusters 50, however the balusters 50 can be formed in any other desired configuration as long as the bore 54 is spaced from the front face 56 of each baluster in a manner which allows the front face 56 to align with the lip 36 of the lower rail 30. In the embodiment shown the side faces 58 of the balusters 50 are equidistant from the bore 54, however this is not essential and a precise on-center spacing between balusters 50 can be obtained even if the baluster 50 is not laterally symmetrical relative to the bore 54.

Various embodiments of the present invention having been thus described in detail by way of example, it will be apparent to those skilled in the art that variations and modifications may be made without departing from the invention. The invention includes all such variations and modifications as fall within the scope of the appended claims.

I claim:

1. A method of assembling a guard rail, comprising the steps of:

a. pre-drilling a top retainer and a bottom rail for attachment to a plurality of hollow balusters, the top retainer having an exterior surface having a pair of opposed channels and each baluster comprising a plurality of inner webs affixed to a wall of the baluster and to a bore for a fastener disposed within the baluster wall, b. disposing fasteners through the holes into the bores to affix the balusters between the top retainer and bottom rail, c. sliding a hand rail having an internal surface having a pair of projections complementary to the channels over the upper retainer to engage the projections in the channels, and d. affixing the top retainer and the bottom rail to posts.

2. The method of claim 1 wherein the hand rail comprises a bearing plate supported by an upper surface of the upper retainer.

3. The method of claim 1 including, before step a., the step of extruding the top retainer, bottom rail, balusters and hand rail.

4. The method of claim 3 wherein each post is hollow and including the steps of anchoring a structural member and disposing the post over a structural member.

* * * * *